US005237144A

United States Patent [19]

Iguchi

[11] Patent Number: 5,237,144

[45] Date of Patent: Aug. 17, 1993

[54] ELECTROMAGNETIC INDUCTION HEATER

[75] Inventor: Atsushi Iguchi, Kyoto, Japan

[73] Assignee: Nikko Co., Ltd., Kyoto, Japan

[21] Appl. No.: 716,105

[22] Filed: Jun. 17, 1991

[30] Foreign Application Priority Data

Jun. 18, 1990 [JP] Japan ..... 2-160696
May 13, 1991 [JP] Japan ..... 3-107602

[51] Int. Cl.[5] ..... H05B 6/36

[52] U.S. Cl. ..... 219/10.79; 219/10.491; 219/10.51; 219/10.75; 219/10.77; 60/670; 60/690; 392/441; 392/456

[58] Field of Search ..... 219/10.75, 10.491, 10.79, 219/10.43, 10.51, 10.77, 10.493, 201; 392/457, 451, 468, 472, 441, 449, 455, 456; 60/670, 690

[56] References Cited

U.S. PATENT DOCUMENTS

| | | | |
|---|---|---|---|
| 3,116,392 | 12/1963 | Morey | 219/10.491 |
| 3,747,333 | 7/1973 | Gerstmann et al. | 392/451 |
| 3,936,625 | 2/1976 | Burnett | 219/10.51 |
| 3,964,416 | 6/1976 | Kiraly et al. | 219/201 |
| 4,136,276 | 1/1979 | Ashe | 219/378 |
| 4,471,191 | 9/1984 | Greis et al. | 219/10.51 |
| 4,532,398 | 7/1985 | Henriksson | 219/10.79 |
| 4,697,067 | 9/1987 | Rosset et al. | 219/401 |
| 4,823,767 | 4/1989 | Wust | 219/401 |
| 4,874,916 | 10/1989 | Burke | 219/10.75 |
| 4,999,467 | 3/1991 | Iguchi | 219/10.493 |
| 5,061,835 | 10/1991 | Iguchi | 219/10.79 |

FOREIGN PATENT DOCUMENTS

| | | |
|---|---|---|
| 075811 | 9/1981 | European Pat. Off. . |
| 252719 | 7/1987 | European Pat. Off. . |
| 380030 | 1/1989 | European Pat. Off. . |
| 802634 | 9/1936 | France . |
| 2196568 | 3/1974 | France . |
| 2130058 | 5/1984 | United Kingdom . |

*Primary Examiner*—Bruce A. Reynolds
*Assistant Examiner*—Tu Hoang
*Attorney, Agent, or Firm*—Fish & Richardson

[57] ABSTRACT

An induction coil is formed by winding an electrically conductive wire around an iron core, and at least one turn of a pipe of electrically conductive material is wound around the induction coil. The pipe is short-circuited at positions other than where the pipe is wound around the induction coil. An A.C. power source is connected to the induction and preheated fluid is supplied to the pipe to be further heated by induction within the pipe. Since the pipe has a large heat transfer area, efficient heat exchange can be obtained. This heating system is connected to a steam generator, which supplies the preheated fluid to it. The steam generator includes an induction coil of an electrically conductive wire wound on an iron core and a metal material forming a plate disposed on the iron core. The bottom surface of the metal material provides a magnetic flux path for the induction coil. An A.C. power source is connected to the induction coil to induce induction heating in the plate and thus to vaporize water or other fluid supplied to the steam generator into a space within the steam generator above the plate. The steam generator also includes a gas-liquid separator above the plate for separating steam from condensed droplets.

11 Claims, 5 Drawing Sheets

ELECTROMAGNETIC INDUCTION HEATER

BACKGROUND OF THE INVENTION

1. Field of the Invention

This invention relates to novel electromagnetic induction heaters which can heat fluids such as water and steam stably to a predetermined temperature. More specifically, the invention concerns a super-heated steam generator which can heat steam to a temperature of 100° C. or above under normal pressure.

2. Description of the Prior Art

Steam can provide high latent heat or heat of condensation, and therefore it is useful as source of heat. Particularly, steam at 100° C. or above is useful in various fields such as boilers, concentrated air conditioning systems, heating sources for various factory machines and apparatuses, irons and steamers for food. Steam is further used for various other purposes.

Heretofore, steam at 100° C. or above can be obtained in a steam piping provided in a multi-pipe heat exchanger or the like by burning such fuel as petroleum, gas and coal, while at the same time the steam is saturated by application of pressure (of 20 to 60 atmospheres (kg/cm$^2$), for instance). Alternatively, the steam piping is heated with combustion gas or an electric resistance heater.

However, where petroleum, coal, natural gas, etc. are burned for boilers or the like, fire prevention or like safety means are necessary. In addition, because of very great temperature difference between the heating portion and water or steam that is heated, what is commonly termed "scale" deposits in the heating pipe, reducing the coefficient of heat transfer and eventually resulting in cracks in the pipe. Therefore, it is necessary to carry out scale prevention treatment of water supplied to the boilder in advance by removing bubbles (oxygen removal), using chemical agents or by maintaining alkaline property of water. Moreover, a system is widely practiced in hotels or the like in which steam is produced by burning petroleum, coal, natural gas, etc. and circulated as a source of room heat or the like in the overall building. Such a system, however, is subject to great energy loss and cannot be an efficient system at all times.

Further, where an electric resistance heater is provided in water, water is heated to a temperature far higher than 100° C., i.e., its boiling point, in the neighborhood of the heat source. Therefore, if a heater without a sufficient boundary surface heat transfer area is used, various troubles are produced.

Further, since an electric resistance heater, like the burning of gas, produces extraordinary temperature difference between the heating source and the water, inorganic and organic components contained in water are adsorbed to and accumulated on the heater surface and act as heat insulator, thus reducing the heat conductivity and retarding the boiling of the water. At the same time, heat radiation from the heater deteriorates, eventually leading to heater lead breakage. To avoid this accident, the heater for heating water is provided with great surface area and accommodated in the full space of the water tank, thus presenting the problems of cumbersomeness of heater exchange and also reliability problems.

Further, washing the heating element, which is required due to attachment of filth, is very timeconsuming.

Further, it is difficult to obtain accurate steam temperature control, which is has heretofore been basically impossible to improve.

Further, in the above case it is necessary to provide an absolute pressure of about 16 kg/cm$^2$ for obtaining saturated steam at 200° C., to provide an absolute pressure of about 41 kg/cm$^2$ for obtain steam at 250° C. and to provide an absolute pressure of about 90 kg/cm$^2$ for obtaining steam at 300° C. This means that the prior art steam generator inconveniently requires the use of a pressure-bearing vessel.

SUMMARY OF THE INVENTION

The present invention has been intended in order to solve the above problems inherent in the prior art, and its object is to provide an electromagnetic induction heater which permits super-heated steam (which is at a temperature of 100° C. or above under normal pressure) stably with a simple apparatus, as well as being readily temperature controllable and requiring no pressure-bearing vessel.

To attain the above object, the electromagnetic induction heater according to the invention has the following construction.

An electromagnetic induction heater comprising an induction coil formed by winding an electrically conductive wire on an iron core and at least one turn of a pipe of an electrically conductive material on the induction coil, the pipe being short-circuited at positions other than the wound portion. A.C. power source is connected across the induction coil, and fluid is passed through the pipe.

It is preferable in this invention that A.C. (alternating current) power source is a commercial frequency A.C. power source.

It is preferable in this invention that the fluid supplied to the pipe is steam, and that the fluid output from the pipe is super-heated steam.

It is preferable in this invention that the pipe has uneven or have fins on its inner surface.

Another aspect of this invention it constitutes an electromagnetic induction heating steam generator including a steam generation vessel serving as a first vessel and provided with an induction coil having an electrically conductive wire wound on an iron core and a metal material provided on the iron core and having a bottom surface capable of constituting a magnetic flux path, fluid supply means provided in the steam generation vessel, means for removing out heated steam from the steam generation vessel and means for connecting a low frequency A.C. power source to the induction coil. The electromagnetic induction heating steam generator isconnected to said electromagnetic induction heater.

It is preferable in this aspect of the invention that the fluid supplied is water, and that the steam generation vessel has a rusting prevention materialists on its inner surface.

It is preferable in this aspect of the invention that the gas-liquid separator can also be provided in the steam generation vessel.

Finally, one can employ means for maintaining a constant temperature in the heater of this invention.

DETAILED DESCRIPTION OF THE INVENTION

Figure 1:
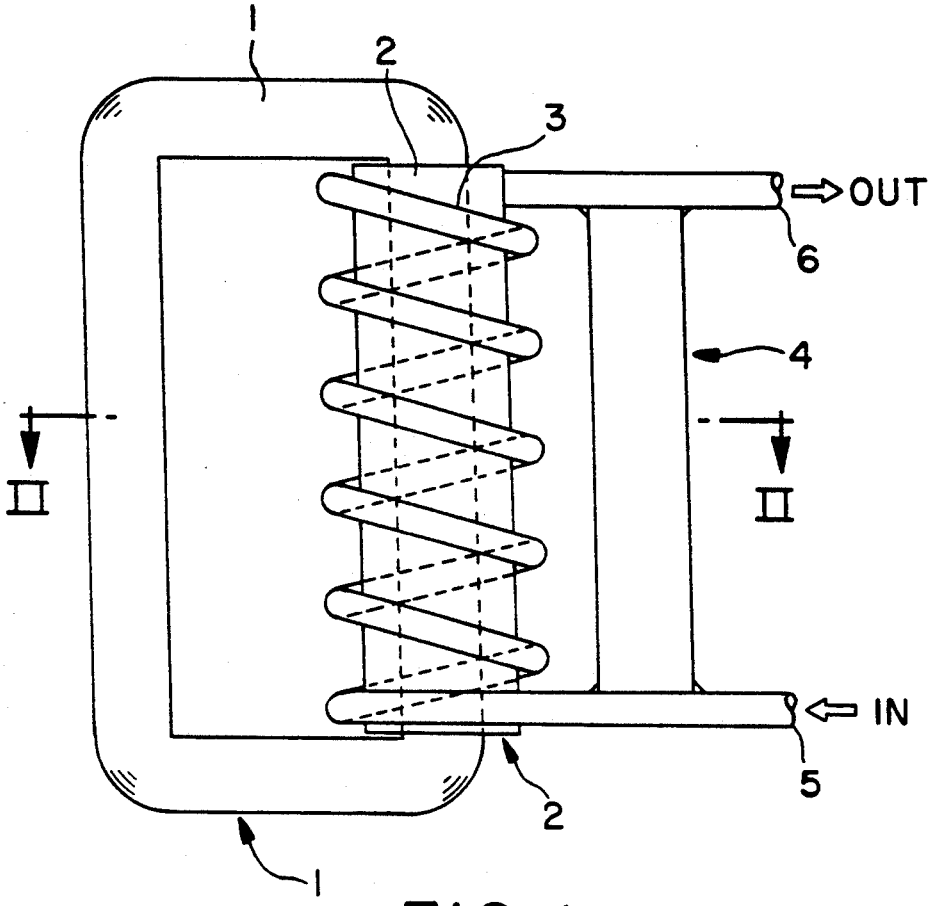
FIG. 1 is an elevational view showing an embodiment of the heater according to the invention.

In the construction according to the invention, an induction coil is formed by winding electrically conductive wire on an iron core and at least one turn of a pipe of an electrically conductive material on the induction coil. The pipe is short-circuited at positions other than the wound portion, thus forming an electromagnetic induction heater. An A.C. power source is connected across the electrically conductive wire and a low voltage large current is passed through the pipe. Under the commonly-known transformer principle this large current generates Joule heat in the pipe to produce efficient heating. Since the pipe has a large heat transfer area, efficient heat exchange can be obtained.

Thus, super-heated steam can be obtained stably under normal pressure, ready temperature control can be obtained, no pressure-bearing vessel is required, and super-heated steam can be obtained with a simple apparatus.

In a preferred mode of the invention, by using a commercial frequency A.C. power source as the A.C. power source the apparatus can be directly connected to the power source, and thus it is possible to provide an apparatus which can be used conveniently.

Another preferred mode of the invention involves the case, in which steam is supplied to the pipe, and super-heated steam is output from the pipe. In this case, super-heated steam can be obtained stably under normal pressure.

With the above preferred construction according to the invention, an induction coil is formed by winding an electrically conductive wire on an iron core and a metal material having a bottom surface capable of constituting a magnetic flux path is provided on top of the iron core. A commercial frequency A.C. power source is connected across the induction coil and a low voltage large current is passed through the metal material on the bottom surface of steam generator (first vessel) capable of constituting a magnetic flux path. This large current generates Joule heat in the metal material at the vessel bottom to produce efficient heating. Further, since supply water is heated in contact with the metal material as the heater, enhanced heat conduction efficiency can be obtained.

Further, since electricity is utilized as the heat source, safety against fire can be ensured, and ready temperature control can be obtained. Besides, heated steam can be obtained without the need of any pressure-bearing vessel and with a simple apparatus.

In a further preferred mode of the invention, the supply liquid is water, and the inner surface of the steam generation vessel is a rusting prevention material. Thus, it is possible to prevent rusting on the vessel when generating steam.

In a still further preferred mode of the invention, gas-liquid separator means is provided in the steam generation vessel, and thus intrusion of spattered liquid into the generated steam can be efficiently prevented.

As has been described in the foregoing, in the construction according to the invention, an induction coil is formed by winding an electrically conductive wire on an iron core, and at least one turn of a pipe of an electrically conductive material in inturn on the induction coil. The pipe is short-circuited at positions other than the wound position, thus forming an electromagnetic induction heater, which is operated by connecting an A.C. power source across the electrically conductive wire. A low voltage large current is passed through the pipe, which generates Joule heat in the to attain efficient heating. Since the pipe has a large heat transfer area, efficient heat exchange can be obtained.

Now, an embodiment of the invention will be described with reference to the drawings.

Figure 2:
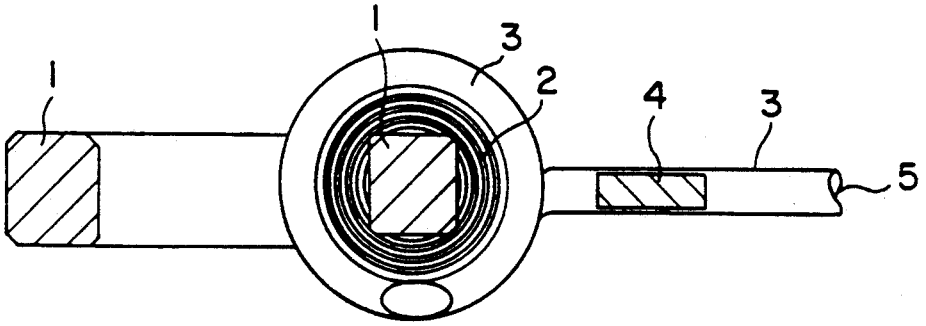
FIG. 2 is a sectional view taken along line II—II in FIG. 1.

Referring to FIGS. 1 and 2, an induction coil 2 is formed by winding an electrically conductive wire around a core 1. At least one turn of a pipe 3 of an electrically conductive material is wound around the induction coil 2, and it is short-circuited at positions other than the wound portion with a short-circuiting member 4, thus forming an electromagnetic induction heater. An A.C. power source is connected across the induction coil 2, and a fluid is supplied through the pipe. As the core 1 may be used a silicon steel plate lamination, which is used as a core of a usual transformer, or an amorphous metal film lamination. The electrically conductive wire forming the induction coil 2 may be a copper wire clad with glass fiber. The pipe 3 may be made of any conductive material so long as it can carry current; for example, it is possible to use a copper pipe or a stainless steel pipe. Further, the pipe 3 may be uneven or have fins on its inner surface. The member 4 is suitably made of a metal offering less electric resistance such as a copper bar.

The operation of this embodiment of the electromagnetic induction heater according to the invention will now be described.

Referring to FIGS. 1 and 2, when A.C. current is passed through the induction coil 2, magnetic flux is produced through the core 1 to generate an induction current through the pipe 4 under the principle of the short-circuited transformer. Since the pipe 3 is by the short-circuiting member 3, it serves as a heat generator. Thus, heat can be obtained through conversion from very slight power and with a minimum of power loss. By supplying a fluid such as water or steam from an inlet 5 of the pipe 3 providing heat, fluid which is heated to a predetermined temperature is discharged from an outlet 6 of the pipe 3. The fluid may be any kind of liquid or gas. For example, it may be air or organic compounds used as heat medium or heaters. Further, the heater may be used as a hydrolysis apparatus as well as a mere heater. It is further possible to use a plurality of heaters according to the invention in series or parallel connection.

As the A.C. current, a low frequency A.C. current up to about 1,000 Hz can be used efficiently. Particularly, 50 Hz or 60 Hz commercial A.C. preferred.

The leg core and yoke core have a sectional area chosen to be able to maintain a magnetic flux density not reaching magnetic saturation, suitably 20,000 gaus or below.

Now, specific experimental examples of the invention will be described.

EXAMPLE 1

An apparatus as shown in FIGS. 1 and 2 was produced.

The core 1 is made from a lamination of silicon steel plates about 0.35 mm in thickness. As the electrically conductive wire of the induction coil 2 was used a copper wire clad with glass fiber. As the pipe 3, six turns of a copper pipe with an outer diameter of 12 mm and an inner diameter of 10 mm were wound on the induction coil. The short-circuiting member 4 was a copper bar (with a rectangular section of 30 mm by 5 mm and a length mm) connected by welding to the pipe 3. As for the size of the heater, with reference to FIG. 1, the height was about 15 cm, the width was about 15 cm, and the about 6 cm.

Commercial current at 60 Hz was passed through induction coil 2 of the apparatus. The energizing power was 92.4 V (1,900 W). Steam at 109° C. constantly through the pipe 3 at a rate corresponding to 15 liters/hr. of water at 20° C. After one seconds from the start of steam supply, the temperature of steam at the outlet 6 reached 300° C., and super-heated steam at 300° C. could be obtained

EXAMPLE 2

An induction heater (first vessel) shown in FIGS. 3 to 8 was used to produce saturated steam to be supplied to the inlet 5 shown in FIGS. 1 and 2.

Figure 4:
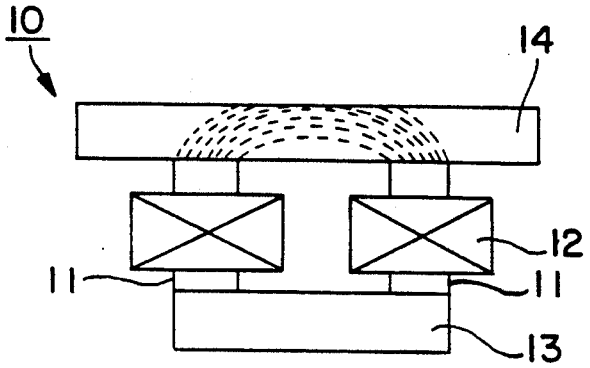
FIG. 4 is a view for explaining the principles of electromagnetic induction heater 10 shown in FIG. 3.

The principle shown in FIG. 4 will first be described. Induction coils 12 are wound on leg cores 11, a yoke core 13 is bonded to the bottoms of the leg cores 11, and an iron plate 14 is placed on the leg cores 11. The leg cores 11 and induction coil 12 are basically the same as those shown in FIG. 1. The yoke core 13 may be a disk like lamination of a plurality of silicon steel sheets. For example, an elongate silicon steel sheet having a width of several centimeters may be wound into a cylindrical form, which may be disposed such that its flat portion (i.e., an end face of the steel sheet) is in contact with the leg cores. The iron plate 14 forms a magnetic path and serves as a heat generator. This means that it may be replaced with any other material which can set up a magnetic flux and serve as a heat generator.

When an A.C. power source at a commercial frequency is connected to the induction coil of the heater 10, a magnetic flux is set up in the cores 11 and 13 and also in the iron plate 14, and thus Joule heat is generated to heat the iron plate 14.

Figure 5:
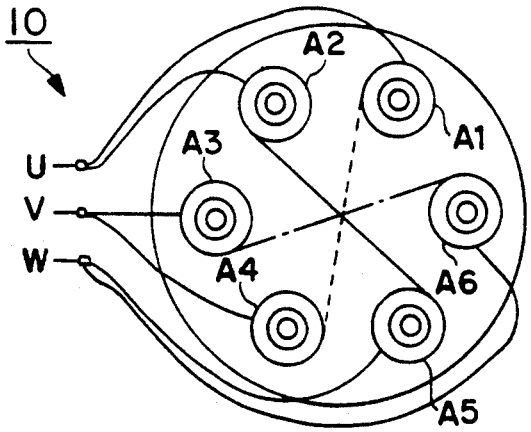
FIG. 5 is a connection diagram showing an example of electric connection of the electromagnetic induction heater shown in FIG. 3.

As a suitable electric connection of the heater, as shown in FIG. 5, six coils A1 to A6 are connected in a delta connection using a three-phase AC power source. With this connection, forces of attraction are produced between the leg cores 11 and iron plate 14 and prevent generation of abnormal sound vibrations.

Figure 6:
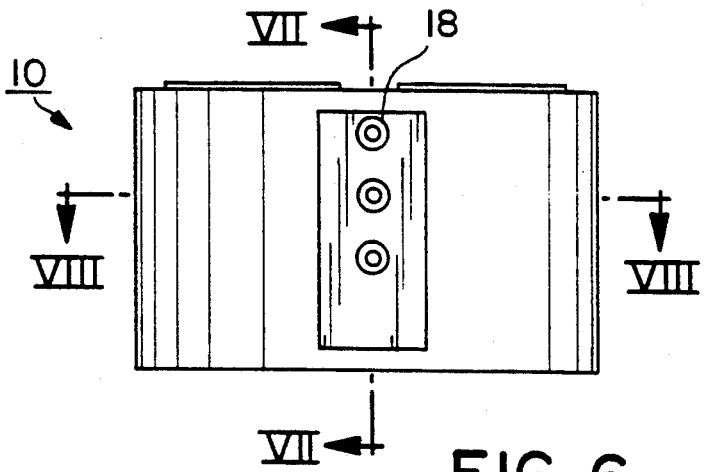
FIG. 6 is an elevational view showing an embodiment of the FIG. 5.
Figure 7:
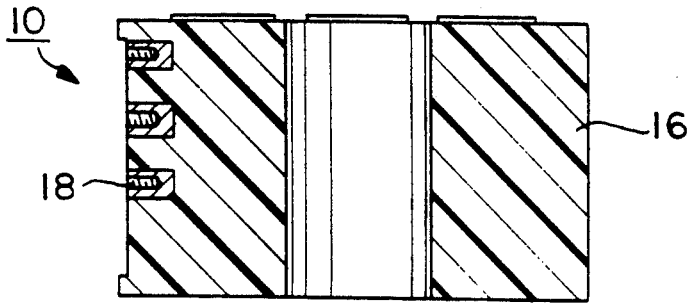
FIG. 7 is a sectional view taken along line VII—VII in FIG. 6.

Referring to FIGS. 6 and 7, designated at 18 are terminals for connecting the three-phase power source.

Figure 8:
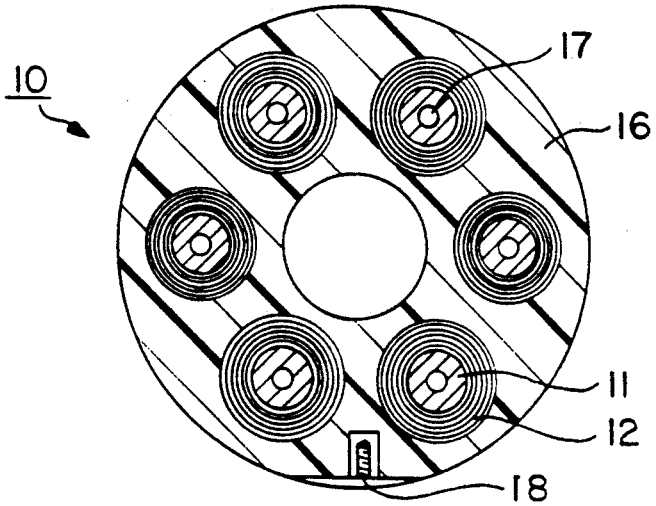
FIG. 8 is a sectional view taken along line VIII—VIII in FIG. 6.

Referring to FIGS. 7 and 8, a resin molding 16 is not an essential element. It is preferably absent when generating steam at a high temperature.

A steam generator 20 using the heater 10 having the above construction will now be described with reference to FIG. 3.

In the first place, the electromagnetic induction heater 10 and iron plate 14 are secured to each other with bolts 17. The upper surface of the iron plate 14 is preferably provided with a layer of stainless steel (for instance "SUS-316") as a rusting prevention layer 15. In the instant example, "SUS-316" was integrated with a thickness of 1 mm. This layer may be replaced with any other layer so long as rusting prevention is provided, for instance with glass lining or fluorine resin coating.

A steam generation vessel 21 made of stainless steel (for instance "SUS-316") is secured to the top of the iron plate 14 provided with the rusting prevention layer 15. The steam generation vessel 21 consists of barrel and cap portions coupled together by flange portions 31. Scale accumulated in the trough can be readily removed by separating the flange portions. The steam generation vessel 21 is provided with a pressure gauge 22 and a safety valve 23. Water supplied by a pump 25 from a water supply port 24 through a check valve 26 is jet from water jet orifices onto the iron plate 14 provided with the rusting prevention layer 15. The iron plate 14 can be held at a temperature of, for instance, 150° C. to 200° C., and thus steam can be produced instantly according to the rate of water supply. When the water supply rate is 15 liters/hr., the power supply to the coil 10 is sufficiently 200 V, 9 kW.

Steam generated on the iron plate 14 is deprived of liquid by a gas-liquid separator 28, and saturated steam is discharged through a needle valve 29 and a steam outlet to the outside.

When the volume of the steam generator 21 is 8 to 10 liters and the water supply rate is 15 liters/hr., saturated steam at about 109° C. can be obtained stably with with an inner pressure of about 1 $kg/cm^2$ as gauge pressure (which is about 2 $kg/cm^2$ as absolute pressure). This steam generator is never damaged even if it is idly operated because of temperature control of the apparatus. Further, with temperature control of the iron plate 14 a constant temperature can be maintained. When there is no water supply, the steam generator may be operated with 10 to 20% of power supplied in the normal operation. As for the overall size, the steam generator has a diameter of about 30 cm and a height of 40 to 50 cm, and thus it can be readily moved. Where the steam generator is produced as mobile one, a cartridge type water supply is preferred.

Figure 3:
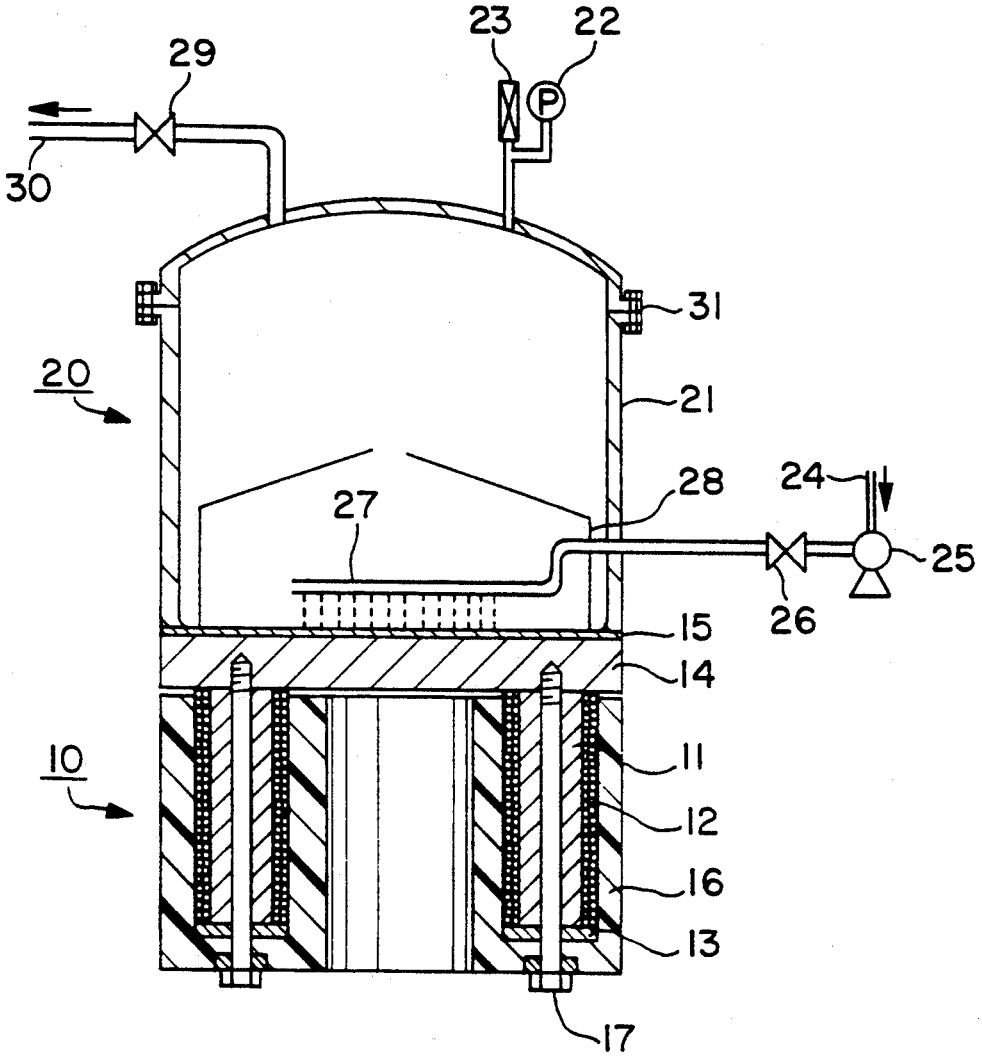
FIG. 3 is a sectional view showing a saturated steam generator used with the embodiment of the invention.

In the instant example, a steam outlet 30 of the steam generator shown in FIG. 3 was connected via a stainless steel pipe to the inlet 5 shown in FIG. 1, and water at 20° C. was supplied constantly at a rate of 15 liters/hr. to the steam generator shown in FIG. 3. Steam at a temperature of 109° C. was supplied to the inlet 5 of the pipe 3 in the heater shown in FIG. 1. Table 1 shows the power and voltage supplied to the heater shown in FIG. 1 and temperature of super-heated steam obtained from the outlet 6 of the pipe 3.

TABLE 1

| Supply power | Supply voltage | Steam temperature |
|---|---|---|
| (in W) | (in V) | (in °C.) |
| 300 | 29.1 | 118 |
| 500 | 39.0 | 141 |

TABLE 1-continued

| Supply power | Supply voltage | Steam temperature |
|---|---|---|
| 800 | 51.9 | 174 |
| 1,000 | 59.9 | 199 |
| 1,200 | 67.7 | 233 |
| 1,400 | 75.5 | 246 |
| 1,600 | 82.4 | 269 |
| 1,800 | 89.5 | 290 |
| 1,900 | 92.4 | 300 |

Figure 9:
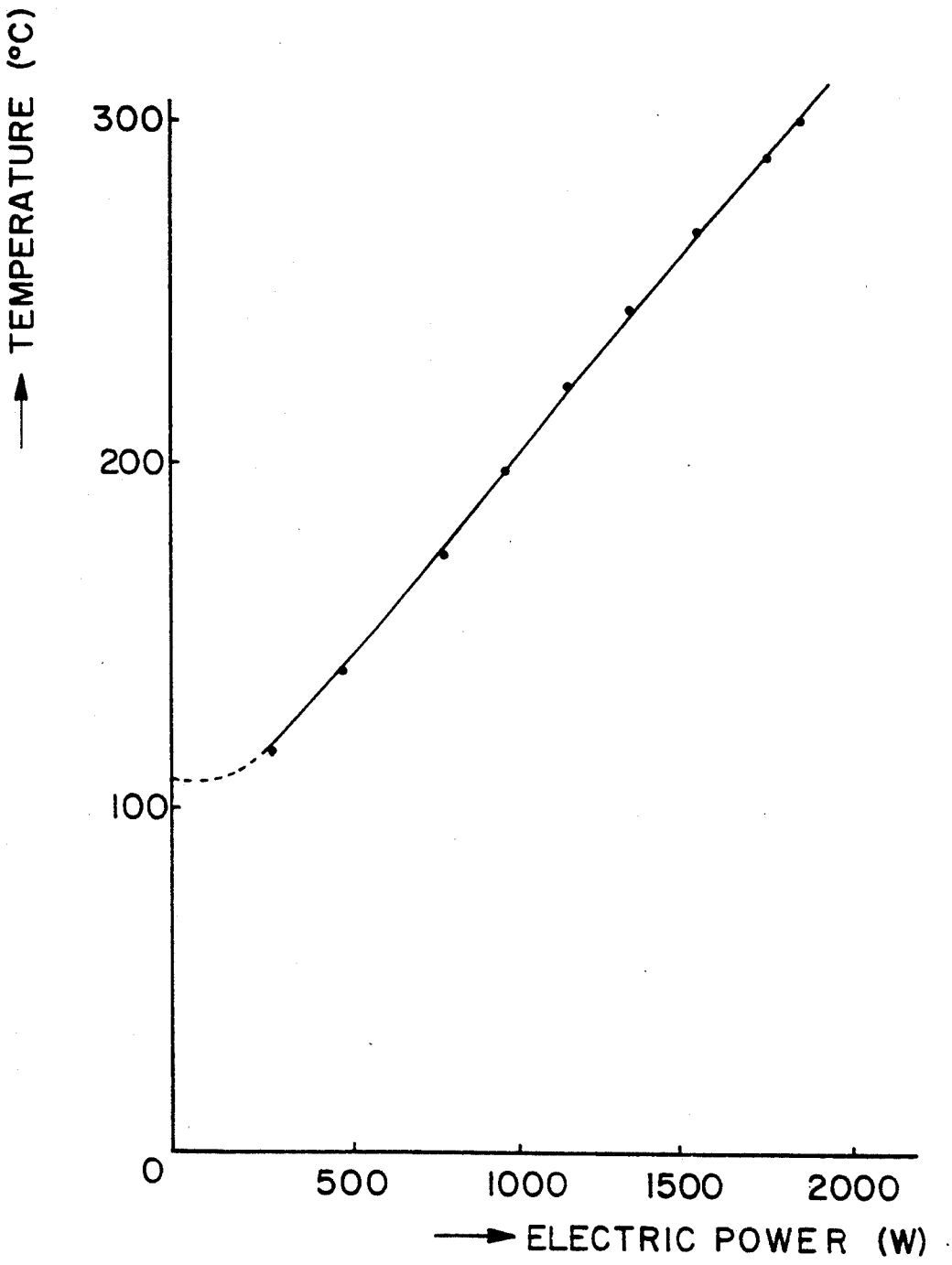
FIG. 9 is a graph showing a temperature versus power plot for explaining the results of the embodiment of the invention.

FIG. 9 shows the results shown in Table 1. It was confirmed that with a constant steam supply rate super-heated steam at a predetermined temperature could be obtained in proportion to the power level.

The steam generator may of course be temperature insulated as a whole to prevent heat radiation.

With the above embodiment of the invention, the following advantages can be obtained.

(1) Super-heated steam at a predetermined temperature can be obtained stably and quickly. Particularly, the embodiment is effective as small size boilers.

(2) The apparatus is inexpensive, and since it is not a pressure vessel, no pressure vessel license is necessary.

(3) Since the apparatus is small in size and utilizes electric power, it can be freely moved quickly to a desired place for use. To this end, it may be constructed as wagon type. Further, the electric power cost is much less inexpensive than with a resistance heater.

(4) Since the apparatus is compact and can be operated at any time and in a desired place when intended, it is useful as a steamer which is used only in certain seasons.

(5) The apparatus is not damaged when it is operated in an idle condention because it is temperature controlled.

(6) Since the apparatus utilizes electricity, it can ensure high safety as a heating source.

(7) The apparatus is useful for small size boilers concerning food such as steamers, iron steam generators, small size boilers for cleaning shops and restaurants and so forth.

(8) The heater according to the invention can elevate the steam temperature up to about 400° to 600° C. Therefore, by combining high temperature steam (which is seemingly partially decomposed into oxygen and hydrogen) with necessary air, gas, petroleum and coal combusters (or boilers) and engines, it is possible to promote combustion. Air is composed of about 80% of nitrogen gas and has low oxygen content contributing to the combustion. This means that efficient combustion can be obtained if oxygen or a component which can readily become oxygen can be supplied. The heater according to the invention can be utilized as a gas generator for supplying gases for the above combustion purposes.

(9) Further, the heater according to the invention can be utilized as a decomposition gas generator, i.e., pyrolysis apparatuses for causing thermal decomposition of petroleum and gasoline. This is so because heating to high temperatures can be readily obtained.

I claim:

1. An electromagnetic induction system, comprising:

(a) an electromagnetic induction heating steam generator including a steam generation vessel provided with a first induction coil comprising a first electrically conductive wire wound on a first iron core and a metal material provided on said first iron core and having a bottom surface capable of constituting a magnetic flux path;

a first A.C. power source connected across said first induction coil to induce induction heating in the metal material when power is supplied to said first induction coil from said first A.C. power source;

fluid supply means provided in said steam generation vessel for supplying fluid capable of being turned into steam into a space within said steam generator above the metal material; and means for taking out heated steam from said steam generation vessel; and (b) an electromagnetic induction heater connected to said means for taking out heated steam from said steam generation vessel, including:

a second induction coil formed by an electrically conductive wire wound on a second iron core and at least one turn of a pipe of an electrically conductive material wound on said second induction coil, said pipe being short-circuited at positions other than at the portion of the pipe wound on the second induction coil, an input to said pipe being connected to said means for taking out heated steam from said steam generation vessel and an output of said pipe providing heated steam; and a second A.C. power source connected across said second induction coil.

2. The electromagnetic induction system according to claim 1, wherein the fluid output from said pipe is super-heated steam.

3. The electromagnetic induction system according to claim 1, wherein said fluid supplied is water, and said steam generation vessel has a corrosion preventing material on its inner surface.

4. The electromagnetic induction system according to claim 1, wherein said steam generator further comprises a gas-liquid separator provided in said steam generation vessel.

5. The electromagnetic induction system according to claim 1, which further comprises means for controlling the A.C. power source connected to the induction coil to maintain a constant temperature within the steam generation vessel.

6. The electromagnetic induction system of claim 1, wherein said pipe has an uneven inner surface.

7. The electromagnetic induction steam generator of claim 1, wherein said A.C. power source is a 50 to 60 Hz frequency power source.

8. An electromagnetic induction steam generator, comprising:

a steam generation vessel provided with an induction coil comprising an electrically conductive wire wound on an iron core and a metal material disposed on said iron core which has a bottom surface capable of constituting a magnetic flux path, an A.C. power source being connected to said induction coil to induce induction heating in the metal material when power is supplied to said induction coil from said A.C. power source;

fluid supply means in said steam generation vessel for providing a supply of fluid to said steam generation vessel into a space within said steam generator above the metal material;

means for taking out heated steam from said steam generation vessel; and a gas-liquid separator means disposed in said steam generation vessel for separating steam from condensed droplets.

9. The electromagnetic induction steam generator of claim 8, wherein the fluid supplied is liquid water and the steam generation vessel has a corrosion preventing material coated on its inner surface.

10. The electromagnetic induction steam generator of claim 8, further comprising means for controlling the A.C. power source connected to the induction coil to maintain a constant temperature within the steam generation vessel.

11. The electromagnetic induction steam generator of claim 8, wherein said A.C. power source is a 50 to 60 Hz frequency power source.

* * * * *